US006757923B2

(12) United States Patent
Sopher et al.

(10) Patent No.: US 6,757,923 B2
(45) Date of Patent: Jul. 6, 2004

(54) EASY-CHANGE MATTRESS SAFETY SHEET SYSTEM

(75) Inventors: Elizabeth Sopher, Denver, CO (US); Joan Henehan, Thornton, CO (US)

(73) Assignee: Clouds and Stars, Inc., Denver, CO (US)

( * ) Notice: Subject to any disclaimer, the term of this patent is extended or adjusted under 35 U.S.C. 154(b) by 0 days.

(21) Appl. No.: 10/136,106

(22) Filed: May 1, 2002

(65) Prior Publication Data

US 2003/0000014 A1 Jan. 2, 2003

Related U.S. Application Data

(60) Provisional application No. 60/302,315, filed on Jun. 29, 2001.

(51) Int. Cl.[7] ..... A47G 9/04

(52) U.S. Cl. ..... 5/496; 5/499; 5/738

(58) Field of Search ..... 5/496, 497, 498, 5/499, 737, 738

(56) References Cited

U.S. PATENT DOCUMENTS

| | | | | | |
|---|---|---|---|---|---|
| 2,154,910 | A | * | 4/1939 | Magaril | 5/722 |
| 2,400,731 | A | * | 5/1946 | Armstrong | 5/500 |
| 2,789,292 | A | * | 4/1957 | Budinquest | 5/496 X |
| 2,907,055 | A | * | 10/1959 | Berman | 5/496 |
| 3,027,573 | A | * | 4/1962 | Bell, Jr. | 5/738 |
| 3,287,749 | A | * | 11/1966 | Marsico | 5/716 |
| 3,493,980 | A | * | 2/1970 | Haller | 5/716 |
| 3,570,026 | A | | 3/1971 | Allison | |
| 3,581,322 | A | * | 6/1971 | Marsico | 5/699 |
| 3,591,875 | A | | 7/1971 | Zipf, III et al. | |
| 3,789,441 | A | * | 2/1974 | Weiss | 5/497 |
| 3,950,800 | A | * | 4/1976 | Garshfield | 5/738 |
| 4,266,307 | A | * | 5/1981 | Critelli | 5/679 |
| 4,388,738 | A | * | 6/1983 | Wagner | 5/421 |
| 4,490,866 | A | * | 1/1985 | Stanton | 5/737 |
| 4,922,565 | A | | 5/1990 | Blake | |
| 4,951,335 | A | * | 8/1990 | Eady | 5/709 |
| 5,003,655 | A | * | 4/1991 | Kafai | 5/496 |
| 5,027,456 | A | * | 7/1991 | Wadsworth | 5/424 |
| 5,042,099 | A | | 8/1991 | Brenner et al. | |
| 5,065,485 | A | * | 11/1991 | Zocco | 29/91.1 |
| 5,086,530 | A | | 2/1992 | Blake | |
| 5,101,527 | A | * | 4/1992 | Wadsworth, III et al. | 5/496 X |
| 5,134,736 | A | * | 8/1992 | Anthony et al. | 5/497 X |
| 5,136,741 | A | * | 8/1992 | Balonick et al. | 5/738 |
| 5,398,354 | A | * | 3/1995 | Balonick et al. | 5/728 |
| 5,414,882 | A | * | 5/1995 | Goodale | 5/691 |
| 5,628,093 | A | * | 5/1997 | Goodale | 24/381 |
| 5,644,811 | A | * | 7/1997 | Cavazos | 5/738 |
| 6,243,895 | B1 | * | 6/2001 | Amin | 5/498 |
| 6,263,532 | B1 | * | 7/2001 | Miller | 5/690 |
| 2002/0148047 | A1 | * | 10/2002 | Corzani et al. | 5/738 |
| 2003/0000014 | A1 | * | 1/2003 | Sopher et al. | 5/496 |
| 2003/0106157 | A1 | * | 6/2003 | Rugset | 5/738 |
| 2003/0177579 | A1 | * | 9/2003 | Diak-Ghanem | 5/499 |

FOREIGN PATENT DOCUMENTS

| | | | | |
|---|---|---|---|---|
| FR | 2579439 | * | 10/1986 | 5/499 |

* cited by examiner

*Primary Examiner*—Robert G. Santos
(74) *Attorney, Agent, or Firm*—Mintz, Levin, Cohn, Ferris, Glovsky and Popeo, P.C.; Iver R. Elrifi; Naomi S. Biswas

(57) ABSTRACT

An easy-change mattress safety sheet system has a top panel that is completely removable and a bottom base that covers the underneath and four sides of a mattress. The base is designed to secure the top panel in place. The top and bottom panels are secured by a simple attaching means that covers the entire perimeter of the top plane of the mattress. The top panel can be completely removed from the base of the sheet by unfastening the simple attaching means. Removal of the top panel can be easily accomplished without disturbing the mattress, sheet base or crib bumpers. The sheet is secure on the mattress and will not allow entanglement of the child in the fabric.

12 Claims, 1 Drawing Sheet

EASY-CHANGE MATTRESS SAFETY SHEET SYSTEM

RELATED APPLICATIONS

This application claims priority to U.S.S. No. 60/302,315, filed Jun. 29, 2001 which is herein incorporated by reference in its entirety.

FIELD OF THE INVENTION

This invention relates to an easy-change mattress safety sheet system for a crib, toddler bed, bunk bed, or similar type bed that has side panels or rails that are not easily removable. The presence of the side panels or rails limit the ability to secure a standard sheet onto the mattress without completely removing it from the crib, toddler bed, bunk bed, or other type of bed.

BACKGROUND OF THE INVENTION

The process of placing a standard sheet on a crib mattress, toddler bed, bunk bed, or other bed with side rails is difficult since the corners of the sheet have to be tucked under the four corners of the mattress. Access to the corners of the mattress are restricted by the slats and rails that are inherent to most baby cribs, toddler beds, and bunk beds. Access is further restricted by the presence of bumpers used in most standard cribs. New mattress designs use squared corners to limit a child's ability to access the area between the mattress sides and the insides of the crib slats or walls. This further impedes the ease and speed at which a crib sheet, toddler bed sheet, or bunk bed sheet can be changed.

The typical method by which a crib sheet, toddler bed sheet, or bunk bed sheet is changed is to remove the bumpers, lift or entirely remove the mattress from the bed or crib, and remove the standard or bunk bed crib sheet by pulling the sheet from beneath the four corners of the mattress. The process is then reversed to remake the bed. The four corners of the standard crib, toddler bed, or bunk bed sheet are secured to the mattress. The mattress is placed back into the crib, toddler bed, or bunk bed and the bumpers or rails are secured around the perimeter of the bed.

This easy-change mattress safety sheet system design is concerned with both ease of change and the safety of the child. According to the U.S. Consumer Product Safety Commission's records (CPSC Document #5127), several infants have died from strangulation or suffocation from crib sheets that have come off the bed. Incidents not involving death have also been reported where the sheet has come off the mattress and the child has been found wrapped in it.

The design of this easy-change mattress safety sheet has two primary purposes. The first is to improve upon the safety of the standard crib, toddler bed, or bunk bed sheet. The second is to reduce the labor involved in changing a standard crib, toddler bed, or bunk bed sheet when it is positioned in a bed or crib.

The prior art related to crib sheet design has focused on simplifying the process of changing sheets without the need to remove the mattress or bumpers from the crib but has not emphasized safety. This invention addresses the safety problems by employing a simple attaching means which fully encompasses the removable sheet and a base that fully surrounds the mattress which cannot be dislodged by the child. It simplifies the design of a removable top sheet by the use of a simple attaching means. In preferred embodiments, the simple attaching means is a zipper.

Prior art which discloses the use of a zipper or hook and loop fasteners for securing a top sheet generally rely on the use of a fitted mattress pad to secure the sheet. These types of fitted pads are often ill-fitting and not secure enough to hold the sheet in place.

U.S. Pat. No. 4,922,565 to Blake, discloses the use of a composite sheet secured by hook and loop fasteners to a fitted mattress pad. An elastic band extending underneath the mattress is used to tension the mattress pad in place. The installation of the elastic band is not described and could prove difficult without stretching the band excessively so that it would ultimately lose its elasticity. The band also only secures the middle of the pad in place and in the case of a loose fit, the end of the pad and thus the sheet could slip off the mattress. In addition, the hook and loop fasteners secure the sides of the top sheet only, allowing the entrapment of a child along the top and bottom of the sheet.

U.S. Pat. No. 3,591,875 to Zipf describes a disposable mattress cover which fully encircles the mattress; however, the mattress must be slid into the tubular design. In the modified construction that is described, the corners of the mattress must be lifted and inserted into slots which is a cumbersome process due to the tight fit of crib mattresses against the crib slats or walls and the presence of bumpers.

U.S. Pat. No. 5,042,099 to Brenner, U.S. Pat. No. 5,086,530 to Blake and U.S. Pat. No. 3,570,026 to Allison all employ an unsecured fitted mattress pad to hold a sheet or protective pad in place, and they all use a zipper or hook and loop fasteners to secure only a portion of the sheet/protective pad into place. These arrangements do not ensure that the removable sheet or the fitted mattress pad will not become dislodged and allow the entanglement of a child.

As discussed above, there is a need in the art for a crib, toddler bed, or bunk bed sheet which is both easy to change and which provides a safe environment for the baby or child. This invention satisfies that need by providing an easy-change mattress safety system.

SUMMARY OF THE INVENTION

This invention provides a system by which a sheet for a crib, toddler bed, bunk bed, or other bed surrounded by rails or bumpers can be secured in place. By design, it eliminates the possibility of a child removing the corners and wrapping themselves in the fabric. The top sheet is removable from the base by use of simple attaching means that attaches the removable top sheet to the base. This system provides ease of change of the sheets by using the attaching means to remove the top sheet from the base. This system also provides a safe environment for a child in either a crib, toddler bed, or bunk bed, because the attaching means is located where the child can not access it. The attaching means is located inside the perimeter of the top plane of the mattress. The simple attaching means can be covered by a fabric flap, and when the attaching means is a zipper, the zipper can be designed so that the zipper pull can be completely hidden and inaccessible. With these specific design parameters, an adult can access the attaching means to make changing of the crib sheet easy, but a child can not access the attaching means, thereby resulting in a safe environment for the child. Elastic can also be used in the design to allow for adjustability of fit for different sized mattresses.

In one embodiment, the easy-change mattress safety sheet system of the present invention comprises a bottom base sheet and a removable top sheet which are attached by simple attaching means, wherein the base sheet covers the bottom and the four sides of the mattress and the top sheet covers the top surface of the mattress. The simple attaching means is used to securely and detachably attach the top sheet to the base sheet. The simple attaching means can be any type of attaching means, and in preferred embodiments is selected from the group consisting of a zipper, velcro, or a plurality of snaps. When the attaching means is a zipper, the slide of the zipper can be located on the base sheet. Additionally, the zipper can be attached so that the pull of the zipper can be hidden beneath the base of the zipper when fully closed.

The top and base sheet of the easy-change mattress safety sheet system can be made of any fabric suitable for use as a sheet. In preferred embodiments, the sheets are made of cotton fabric. When the sheets are made of cotton, either the top sheet, the base sheet, or both sheets have been pre-shrunk prior to attaching thereon the simple attaching means. In still other embodiments, elastic can be used in the vertical seams and the bottom of the sheet base to allow for adjustability of fit.

In some embodiments, the attaching means can be identical in length to the perimeter of the mattress. Additionally, the attaching means, after securely attaching the top sheet and the base sheet, is located on the mattress perimeter and is hidden under the bumper. In other embodiments of the present invention, the attaching means can be covered by a flap. It is thus an object of the present invention to provide an easy-change mattress safety system that provides both ease of changing a sheet without removing either the bumpers or the mattress and a safe environment for a child in the bed. This object is achieved by the specific design of the system which comprises an attaching means to attach a removable top sheet to a base sheet, wherein the attaching means can be easily access by adults, while at the same time the attaching means is inaccessible to the child in the crib or bunk bed.

In the easy-change mattress safety sheet system of the present invention, the mattress cane be used in a bed of any type, and is more preferably used in a bed which has some type of side railings, including bed types such as a crib, a toddler bed, or a bunk bed.

Other features and advantages of the invention will be apparent from the following drawings, detailed description and claims.

DETAILED DESCRIPTION OF THE INVENTION

The present invention features an easy-change mattress safety sheet system. The system includes a bottom base sheet and a removable top sheet which are attached by simple attaching means. The bottom base sheet covers the bottom and the four sides of the mattress and the top sheet covers the top surface of the mattress.

Figure 1:
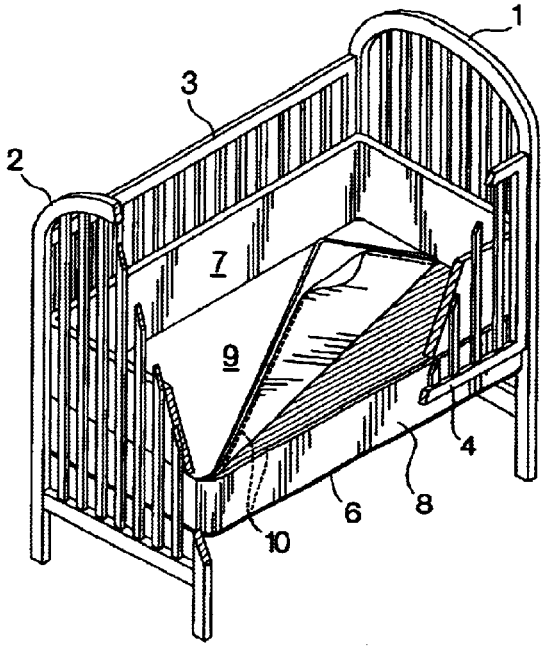
FIG. 1 is perspective view of a crib. It shows the relative positions of the rails, slats, mattress and sheet. It illustrates how the crib sides restrict the user of a standard sheet from installing it without actually removing it from the crib.

Referring specifically to the drawings, FIG. 1 is a perspective view of a crib showing the mattress position in relation to the end panels 1 and 2 and sides 3 and 4 which, in this drawing, are comprised of slats and rails. The sides and ends enclose the mattress 5, which is supported by a platform 6. The bumper 7 sits on the perimeter of the mattress surface and is attached at intervals to the rails.

The easy-change mattress safety sheet system includes a mattress sleeve or base 8 and a top sheet 9. The base and top sheet are attached and become an integral unit with a simple attaching means 10. The attaching means is approximately identical in length to the perimeter of the mattress and, when fully attached, is located on the top surface of the mattress approximately two inches in from the outer edge. The simple attaching means can be any means which can securely fasten the top sheet to the base, including such means as a zipper, velcro, or a plurality of snaps. The attaching means can also be covered by a fabric flap.

In a preferred embodiment, the simple attaching means is a zipper. The zipper can be made out of any suitable material, and in a preferred embodiment the zipper is a moulded plastic, separating zipper. The top sheet and corresponding half of the simple attaching means is expected to be washed much more frequently than the base. In the embodiment wherein the simple attaching means is a zipper, the zipper has been shown to withstand a significant number of washings on only one half and still function as initially designed. In a more preferred embodiment, the slide of the zipper can be located on the base of the sheet for this reason. The zipper is attached in such a way that the zipper pull can be completely hidden from view and inaccessible for children. The zipper surrounds the entire perimeter of the mattress and ends where the base of the zipper or zipper insert is located. The pull can be hidden by extending the zipper teeth at the end of the zipper approximately two inches beyond the point of the zipper beginning, where the zipper insert is attached. The teeth extend under the zipper insert and the zipper pull can be pushed under the insert.

Figure 2:
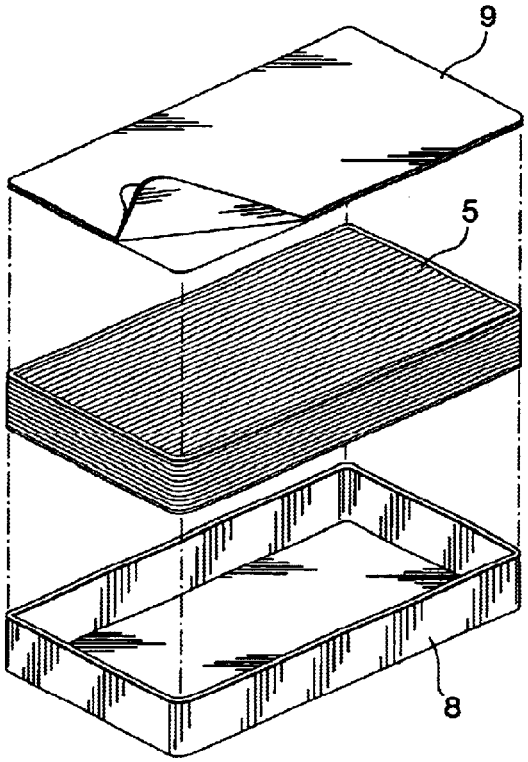
FIG. 2 is a perspective view illustrating the mattress base or sleeve, the top sheet and separating zipper and how the sheet is fitted on the mattress.

The top sheet 9 is illustrated in FIG. 2 as being the same width and length as the mattress 5. This is critical to the design so that the simple attaching means will be located on the mattress perimeter and can be hidden under the bumper. In embodiments when the simple attaching means is a zipper, a preferred embodiment of the zipper is that the half of the separating zipper not containing the slide is affixed to the top sheet. In order to maintain the integrity of the top sheet through numerous washings, there are a variety of possible embodiments of the invention. In one embodiment, the fabric is pre-shrunk prior to cutting and/or attaching the simple attaching means to maintain the integrity.

The sleeve or base 8 is illustrated in FIG. 2. It is approximately identical in length to the length of the mattress plus twice the thickness of the mattress. This allows it to cover the bottom of the mattress and the two ends. The width of the base is approximately identical to the width of the mattress plus twice the thickness of the mattress. Similarly, this allows it to cover the bottom of the mattress and the two sides. Elastic is attached to the vertical seams of the sheet base and in several locations in the bottom of the sheet base to allow for adjustability of fit for mattresses of different thicknesses. The simple attaching means is attached to the top of the base sheet, where it will be securely fastened to the attaching means on the top sheet. The simple attaching means can be any means which can securely fasten the top sheet to the base, including such means as a zipper, velcro, or a plurality of snaps. In a preferred embodiment, the simple attaching means is a zipper. In a more preferred embodiment, the half of the separating zipper containing the slide can be affixed to the base sheet.

In order to maintain the integrity of the base sheet, there are a variety of possible embodiments of the base sheet. In one embodiment, the length of the base sheet is cut on the length of the fabric to maintain the integrity of the base sheet. In another embodiment, as indicated for the top sheet, the base sheet fabric can also be pre-shrunk prior to cutting and/or attaching the simple attaching means to further maintain the integrity.

This design results in an easy-change sheet that allows the removal of the top sheet without disturbing the mattress, base sheet or bumpers. The top sheet can be washed and returned to the bed or a second top sheet can be readily attached. The base sheet, which receives much less direct contact with the child, can be removed and washed or replaced less frequently in the conventional manner in which a standard sheet is installed.

The easy-change mattress safety sheet system of the present invention can be used with any type of mattress, and is especially well-suited for mattresses which are used in beds which have some type of supports surrounding the mattress, such as cribs, toddler beds with protective railings, or bunk beds.

OTHER EMBODIMENTS

Although particular embodiments have been disclosed herein in detail, this has been done by way of example for purposes of illustration only, and is not intended to be limiting with respect to the scope of the appended claims, which follow. In particular, it is contemplated by the inventors that various substitutions, alterations, and modifications may be made to the invention without departing from the spirit and scope of the invention as defined by the claims. It is also to be understood that the drawings are not necessarily drawn to scale, but that they are merely conceptual in nature. Other aspects, advantages, and modifications are considered to be within the scope of the following claims. The claims presented are representative of the inventions disclosed herein. Other, unclaimed inventions are also contemplated. Applicants reserve the right to pursue such inventions in later claims.

What is claimed is:

1. An easy-change mattress safety sheet system comprising a bottom base sheet and a removable top sheet which are attached by a zipper having a zipper pull, wherein the base sheet covers the bottom and the four sides of the mattress and the top sheet covers the top surface of the mattress, wherein the teeth of the zipper extend at the distal end of the zipper beyond the point of the zipper beginning so that the zipper pull can be hidden beneath the base of the zipper when fully closed.

2. The easy-change mattress safety sheet system of claim 1, wherein the slide of the zipper is located on the base sheet.

3. The easy-change mattress safety sheet system of claim 1, wherein the distal end of the zipper extends approximately two inches longer than the perimeter of the mattress.

4. The easy-change mattress safety sheet system of claim 1, wherein the zipper, after securely attaching the top sheet and the base sheet, is located on the mattress perimeter and is hidden under a bumper.

5. The easy-change mattress safety sheet system of claim 1 wherein the top sheet and the base sheet are made of cotton fabric.

6. The easy-change mattress safety sheet system of claim 5, wherein the cotton fabric of the top sheet has been pre-shrunk prior to attaching thereon the zipper.

7. The easy-change mattress safety sheet system of claim 6, wherein the cotton fabric of the base sheet has been pre-shrunk prior to attaching thereon the zipper.

8. The easy-change mattress safety sheet system of claim 1, wherein either or both of the bottom base sheet and removable top sheet further comprise elastic to allow for adjustability of fit.

9. The easy-change mattress safety sheet system of claim 8, wherein the elastic is used in vertical seams and the bottom of the base sheet.

10. The easy-change mattress safety sheet system of claim 1, wherein the mattress is used in a bed selected from the group consisting of a crib, a toddler bed, or a bunk bed.

11. The easy-change mattress safety sheet system of claim 10, wherein the mattress is used in a crib.

12. The easy-change mattress safety sheet system of claim 10, wherein the mattress is used in a bunk bed.

* * * * *